US007415198B2

(12) United States Patent
Lin

(10) Patent No.: US 7,415,198 B2
(45) Date of Patent: Aug. 19, 2008

(54) QUARTZ HEATER TUBE

(76) Inventor: Cheng Ping Lin, 5th Fl., No. 26, Sec. 3, Rein-ai Rd., Taipei (TW)

( * ) Notice: Subject to any disclaimer, the term of this patent is extended or adjusted under 35 U.S.C. 154(b) by 198 days.

(21) Appl. No.: 11/335,551

(22) Filed: Jan. 20, 2006

(65) Prior Publication Data

US 2007/0170166 A1 Jul. 26, 2007

(51) Int. Cl.
*A45D 20/40* (2006.01)
*F24C 7/00* (2006.01)

(52) U.S. Cl. ..... 392/407; 392/424; 392/438; 392/439

(58) Field of Classification Search ..... None
See application file for complete search history.

(56) References Cited

U.S. PATENT DOCUMENTS

| | | | | | |
|---|---|---|---|---|---|
| 4,180,723 | A * | 12/1979 | Szupillo | ..... | 219/541 |
| 5,371,830 | A * | 12/1994 | Wachenheim | ..... | 392/487 |
| 5,557,704 | A * | 9/1996 | Dennis et al. | ..... | 392/480 |
| 5,915,072 | A * | 6/1999 | Campbell et al. | ..... | 392/418 |
| 6,376,816 | B2 * | 4/2002 | Cooper et al. | ..... | 219/543 |
| 7,003,220 | B2 * | 2/2006 | Gerhardinger | ..... | 392/483 |
| 7,081,602 | B1 * | 7/2006 | Black | ..... | 219/523 |
| 7,123,825 | B2 * | 10/2006 | Abbott | ..... | 392/466 |
| 7,206,506 | B2 * | 4/2007 | Sturm | ..... | 392/478 |
| 2003/0077078 | A1 * | 4/2003 | Wu | ..... | 392/440 |
| 2004/0096202 | A1 * | 5/2004 | Konishi | ..... | 392/407 |
| 2005/0100331 | A1 * | 5/2005 | Konishi | ..... | 392/407 |
| 2006/0032847 | A1 * | 2/2006 | Kim et al. | ..... | 219/553 |

* cited by examiner

*Primary Examiner*—Thor S Campbell
(74) *Attorney, Agent, or Firm*—Troxell Law Office, PLLC

(57) ABSTRACT

A quartz heater tube consists of a tube body whose two ends being respectively sealed with a plug, and each plug is provided with a built-in electrode. The inner cavity of the tube body is filled with an inertia gas after being evacuated, and the inner surface thereof is coated with a layer of electrical film which being electrically in connection with the two electrodes. By this construction, when the quartz heater tube is in operation, the electrical film is able to avoid oxidation owing to protection of the inertia gas which serves to isolate the electrical film from the outside air thereby prolonging the lifespan of the quartz heater tube.

3 Claims, 3 Drawing Sheets

QUARTZ HEATER TUBE

BACKGROUND OF THE INVENTION

1. Field of the Invention

The present invention relates to a quartz heater tube, and more particularly, to a quartz heater tube which is strongly resistive to oxidation so as to prolong its lifespan.

2. Description of the Prior Art

Generally, a traditional quartz heater tube is composed of a tube body having electrode formed at each of the two ends, and a layer of electrical film coated on the surface of the tube body, both electrodes are electrically connected to the electrical film so as to apply a voltage between the two electrodes thereby actuating the quartz heater tube to generate heat by the current flowing therein.

However, in a traditional quartz heater tube, the electrical film coated on the surface of the tube is soon to deteriorate due to oxidation under high heating temperature, as a result, the function of quartz heater tube is reduced and its lifespan is greatly shortened.

SUMMARY OF THE INVENTION

In view of the foregoing situation, the inventor of the present invention herein conducted intensive research based on many years of experience gained through professional engagement in the manufacturing of related products, with continuous experimentation and improvement culminating in the development of the improved structure of the quartz heater tube as disclosed herein below to eliminate the defects of prior arts.

The object of present invention is to provide a new structure of a quartz heater tube which is capable of avoiding oxidation of the electrical film so as to prolong the lifespan of the quartz heater tube.

To achieve the above object, the quartz heater tube provided by the present invention consists of a tube body having two ends being respectively sealed with a plug, and each of the plugs is provided with a built-in electrode. The inner cavity of the tube body is filled with an inertia gas after being evacuated, and the inner surface thereof is coated with a layer of electrical film which is electrically connected with the two electrodes. With this structure, when the quartz heater tube is in operation, the electrical film is able to avoid oxidation owing to protection of the inertia gas which serves to isolated the electrical film from the outside air thereby prolonging the lifespan of the quartz heater tube.

Although a preferred embodiment of the present invention has been described for illustrative purposes, those skilled in the art will appreciate that various modifications, additions and substitutions are possible, without departing from the scope and spirit of the invention as disclosed in the accompanying claims.

DETAILED DESCRIPTION OF THE PREFERRED EMBODIMENT

Figure 1:
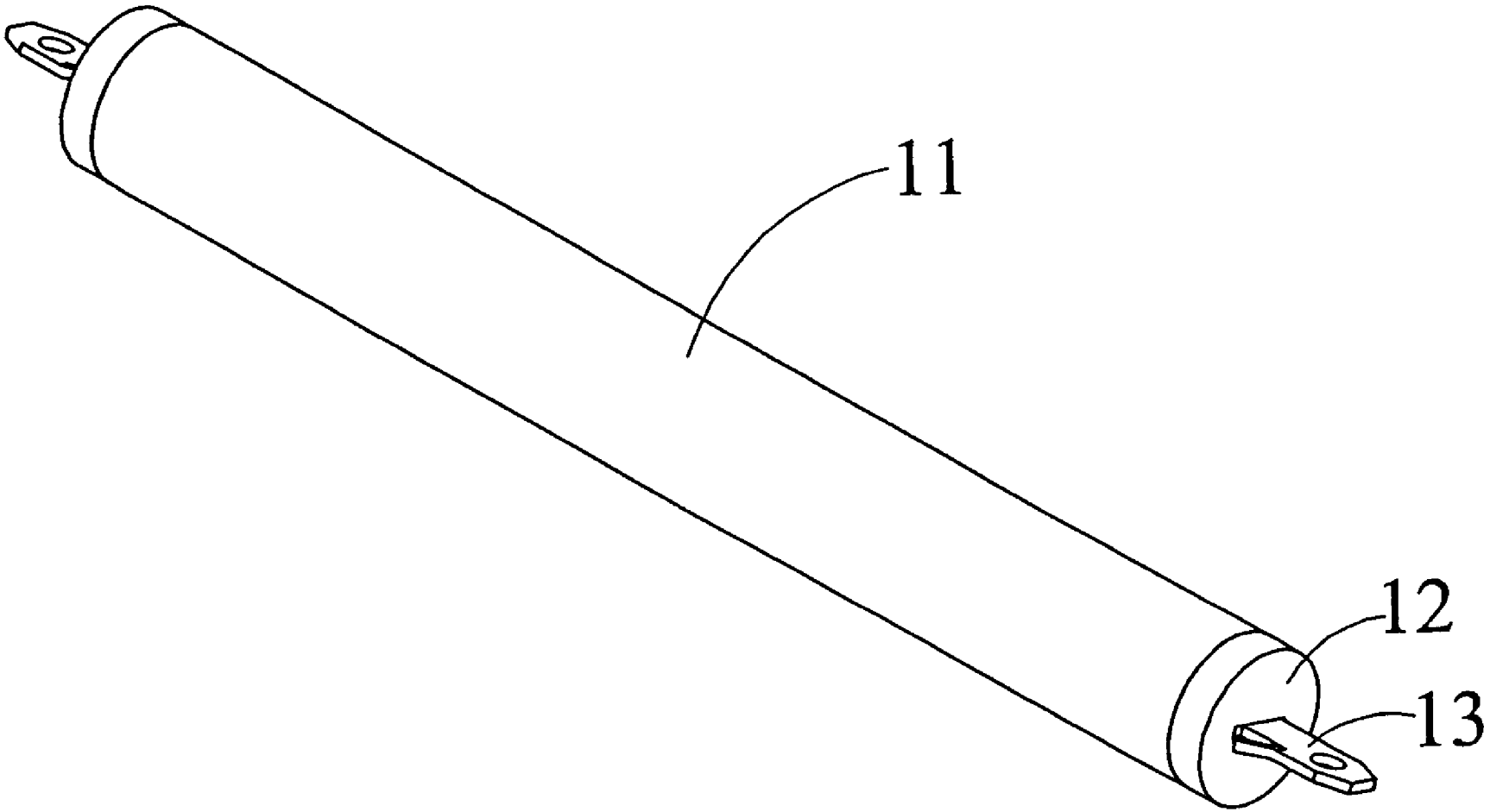
FIG. 1 is a three dimensional perspective view of the present invention.
Figure 2:
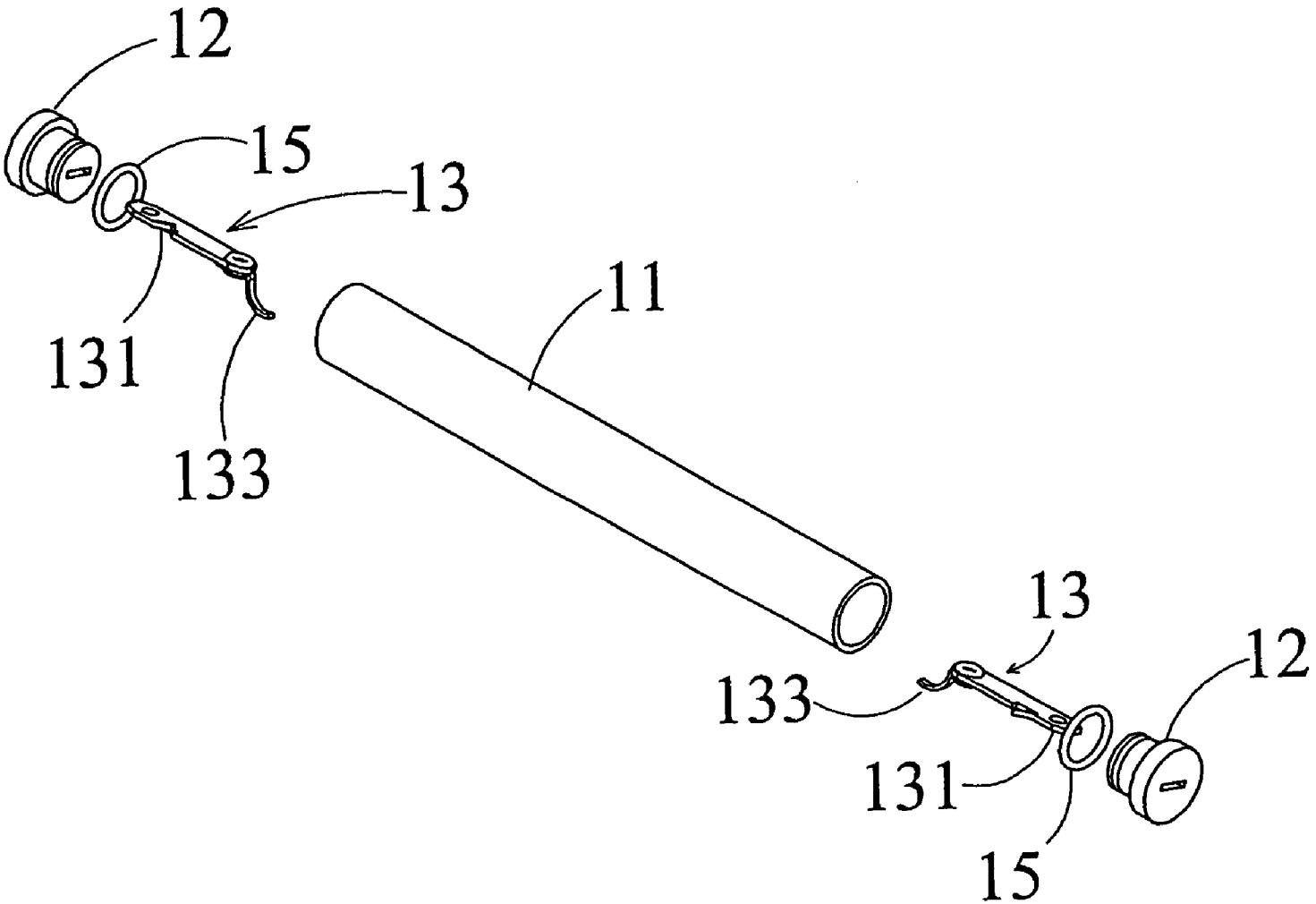
FIG. 2 is an exploded view of the present invention.
Figure 3:
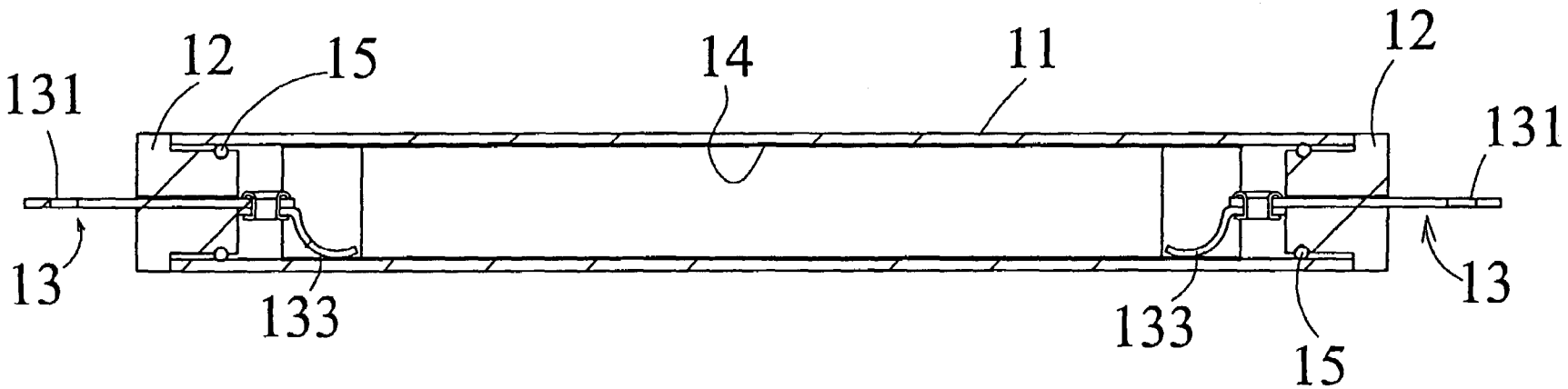
FIG. 3 is a sectional view of the present invention.

Referring to FIG. 1, FIG. 2 and FIG. 3, the quartz heater tube according to the present invention consists of a quartz tube body 11 having two ends being respectively sealed with a plug 12, and each plug 12 is provided with a built-in electrode 13. The inner cavity of the tube body 11 is filled with an inertia gas after being evacuated, and the inner surface thereof is coated with a layer of electrical film 14 being electrically in connection with the two electrodes 13 so as to heat the quartz heater tube by applying a voltage between the electrodes 13 and letting the current flow through the electrical film 14.

With this structure, when the quartz heater tube is in operation, the electrical film 14 is able to avoid oxidation owing to protection of the inertia gas which serves to isolate the electrical film 14 from the outside air with its chemical stability thereby prolonging the lifespan of the quartz heater tube.

Returning again to refer to FIGS. 1, 2 and 3, it can be seen that each electrode 13 is fitted to the plug 12 with its one end emerging out of the plug 12, and being provided with a connecting terminal 131 to connect to a power source or other electrical equipment, while the other end thereof is provided with a spring leaf 133 which is electrically connected to respective end of the electrical film 14. With this structure, when the power is supplied between the electrode 13, the current flows through the electrical film 14 to heat the quartz heater tube.

Referring again to FIGS. 1, 2 and 3, an O-ring 15 is equipped in the quartz tube body 11 fitting with the plug 12 to serve as a packing to ensure airtightness of the quartz tube body 11.

The present invention is a high level technical creation and by no means, simply utilizes conventional technology or knowledge known prior to the application for patent, or can be easily made by persons skilled in the arts. Prior to the application for patent, the invention has neither been published or put into public use, nor displayed in any exhibition therefore the present invention is eligible for applying patent.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A quartz heater tube comprising:

a) a quartz tube body having a hollow interior and an electrical film coating an interior surface of the hollow interior;

b) two plugs sealing two opposing ends of the quartz tube body, one plug of the two plugs is inserted into each of the two opposing ends of the quartz tube body;

c) two electrodes electrically connected to the electrical film, one electrode of the two electrodes is connected to each of the two plugs; and d) an inertial gas filling the hollow interior of the quartz tube body and isolating the electrical film from air outside the quartz tube body.

2. The quartz heater tube according to claim 1, wherein each electrical extends through one plug and has a connecting terminal located on a first end thereof and a spring leaf located on a second end thereof, each connecting terminal is extending outwardly from the quartz tube body, and each spring leaf is located in the hollow interior of the quartz tube body and electrically connected to the electrical film.

3. The quartz heater tube according to claim 1, further comprising two O-rings, one of the two O-rings creating an airtight seal between the quartz tube body and each of the two plugs.

* * * * *